US010112803B2

(12) United States Patent
Marvin et al.

(10) Patent No.: US 10,112,803 B2
(45) Date of Patent: Oct. 30, 2018

(54) PROTECTION ASSEMBLY FOR ELEVATOR BRAKING ASSEMBLY SPEED SENSING DEVICE AND METHOD

(71) Applicant: Otis Elevator Company, Farmington, CT (US)

(72) Inventors: Daryl J. Marvin, Farmington, CT (US); Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 187 days.

(21) Appl. No.: 15/088,908

(22) Filed: Apr. 1, 2016

(65) Prior Publication Data

US 2017/0283217 A1 Oct. 5, 2017

(51) Int. Cl.

| | |
|---|---|
| ***B66B 5/18*** | (2006.01) |
| ***B66B 5/00*** | (2006.01) |
| ***B66B 5/04*** | (2006.01) |
| ***B66B 7/12*** | (2006.01) |

(52) U.S. Cl.
CPC ..... *B66B 5/18* (2013.01); *B66B 5/0031* (2013.01); *B66B 5/044* (2013.01); *B66B 7/1292* (2013.01)

(58) Field of Classification Search
CPC ..... B66B 5/18; B66B 5/0031; B66B 5/044; B66B 7/1292
See application file for complete search history.

(56) References Cited

U.S. PATENT DOCUMENTS 5,117,946 A 6/1992 Traktovenko
5,370,208 A * 12/1994 De Jong ..... B66B 5/22 187/372
5,386,882 A 2/1995 Friend
6,098,755 A 8/2000 Wyssmann
(Continued)

FOREIGN PATENT DOCUMENTS

CN 102730516 A 10/2012
EP 0543337 A2 11/1992
(Continued)

OTHER PUBLICATIONS

Search Report regarding related EP App. No. 17164605; dated Jul. 7, 2017; 5 pgs.

*Primary Examiner* — Michael A Riegelman
(74) *Attorney, Agent, or Firm* — Cantor Colburn LLP

(57) ABSTRACT

A brake assembly for an elevator system includes a guide rail configured to guide movement of an elevator car. Also included is a safety brake operatively coupled to the elevator car and having a brake surface configured to frictionally engage the guide rail. Further included is a safety brake actuation mechanism operatively coupled to the safety brake and configured to actuate the brake member to a braking position. The safety brake actuation mechanism includes a sensing device disposed at a distance from the guide rail to determine a speed of the elevator car relative to the guide rail. The safety brake actuation mechanism also includes a first rigid plate having an inner edge disposed at a distance from the guide rail that is less than the distance that the sensing device is spaced from the guide rail to prevent the sensing device from contacting debris disposed on the guide rail.

17 Claims, 4 Drawing Sheets

(56) References Cited

U.S. PATENT DOCUMENTS

| | | | | |
|---|---|---|---|---|
| 6,128,116 | A * | 10/2000 | Dobler | B66B 1/50 187/391 |
| 6,470,528 | B1 | 10/2002 | Connolly | |
| 6,510,925 | B1 | 1/2003 | De Jong | |
| 6,823,969 | B2 * | 11/2004 | Simmonds | B66B 5/22 187/370 |
| 8,657,076 | B2 | 2/2014 | Beaudry | |
| 8,955,649 | B2 | 2/2015 | Yokobayashi | |
| 2008/0135342 | A1 * | 6/2008 | Thumm | B66B 1/32 187/247 |
| 2011/0308895 | A1 * | 12/2011 | Shen | B66B 5/18 187/359 |
| 2012/0152663 | A1 * | 6/2012 | Legeret | B66B 5/18 187/404 |
| 2013/0098714 | A1 | 4/2013 | Kocher et al. | |
| 2015/0239710 | A1 | 8/2015 | Det | |
| 2016/0236904 | A1 * | 8/2016 | Witczak | B66B 5/22 |
| 2017/0001835 | A1 * | 1/2017 | Hu | B66B 5/18 |
| 2017/0107078 | A1 * | 4/2017 | Hu | B66B 5/22 |
| 2017/0129741 | A1 * | 5/2017 | Hu | B66B 5/22 |
| 2017/0283215 | A1 * | 10/2017 | Hu | B66B 7/00 |
| 2017/0283216 | A1 * | 10/2017 | Marvin | B66B 5/0031 |
| 2017/0291797 | A1 * | 10/2017 | Hu | B66B 5/0031 |
| 2017/0291798 | A1 * | 10/2017 | Hu | B66B 1/32 |
| 2017/0313541 | A1 * | 11/2017 | Wu | B33Y 30/00 |
| 2018/0162693 | A1 * | 6/2018 | Hu | B66B 5/044 |
| 2018/0162694 | A1 * | 6/2018 | Hu | B66B 5/22 |

FOREIGN PATENT DOCUMENTS

| | | | |
|---|---|---|---|
| EP | 2666743 | A1 | 11/2013 |
| GB | 2495527 | A | 4/2013 |
| JP | H09227055 | A | 9/1997 |
| JP | 2004250127 | A | 9/2004 |
| JP | 2009051596 | A | 3/2009 |

* cited by examiner

PROTECTION ASSEMBLY FOR ELEVATOR BRAKING ASSEMBLY SPEED SENSING DEVICE AND METHOD

BACKGROUND OF THE INVENTION

The embodiments herein relate to elevator braking systems and, more particularly, to a protection assembly for an elevator braking assembly speed sensing device, as well as a method of protecting a speed sensing element of an elevator system.

Elevator braking systems may include a safety braking system configured to assist in braking a hoisted structure (e.g., elevator car) relative to a guide member, such as a guide rail, in the event the hoisted structure exceeds a predetermined velocity or acceleration. Some braking systems include an electronic safety actuation device that relies on an optical speed sensing device to detect a car running speed relative to the guide rail. In some cases, it may be possible for material to be present on the guide rail. For example, concrete, cement, debris or the like may build up on the guide rail, such as during a period of elevator installation, especially during the building construction phase. Materials on the guide rail may cause damage to, or reduced operability of, the speed sensing device.

BRIEF DESCRIPTION OF THE INVENTION

According to one embodiment, a brake assembly for an elevator system includes a guide rail configured to guide movement of an elevator car. Also included is a safety brake operatively coupled to the elevator car and having a brake surface configured to frictionally engage the guide rail. Further included is a safety brake actuation mechanism operatively coupled to the safety brake and configured to actuate the brake member to a braking position. The safety brake actuation mechanism includes a sensing device disposed at a distance from the guide rail to determine a speed of the elevator car relative to the guide rail. The safety brake actuation mechanism also includes a first rigid plate having an inner edge disposed at a distance from the guide rail that is less than the distance that the sensing device is spaced from the guide rail to prevent the sensing device from contacting debris disposed on the guide rail.

In addition to one or more of the features described above, or as an alternative, further embodiments may include that the safety brake actuation mechanism further comprises a first guiding pad having an inner surface disposed at a distance from the guide rail that is less than the distance that the first rigid plate is spaced from the guide rail.

In addition to one or more of the features described above, or as an alternative, further embodiments may include that the inner surface of the first guiding pad includes a protrusion pattern extending therefrom, the protrusion pattern comprising a torturous path.

In addition to one or more of the features described above, or as an alternative, further embodiments may include that the safety brake actuation mechanism further comprises a first brush disposed between the first rigid plate and the first guiding pad, the first brush extending to a location closer to the guide rail relative to the distance between the first rigid plate and the guide rail.

In addition to one or more of the features described above, or as an alternative, further embodiments may include that the first rigid plate, the first guiding pad and the first brush are disposed on a first side of the sensing device. The safety brake actuation mechanism also includes a second rigid plate disposed on a second side of the sensing device and having an inner edge disposed at a distance from the guide rail that is less than the distance that the sensing device is spaced from the guide rail to prevent the sensing device from contacting debris disposed on the guide rail. The safety brake actuation mechanism further includes a second guiding pad disposed on a second side of the sensing device and having an inner surface disposed at a distance from the guide rail that is less than the distance that the second rigid plate is spaced from the guide rail. The safety brake actuation mechanism yet further includes a second brush disposed between the second rigid plate and the second guiding pad, the second brush extending to a location closer to the guide rail than the second rigid plate.

In addition to one or more of the features described above, or as an alternative, further embodiments may include that the first rigid plate is formed of steel.

In addition to one or more of the features described above, or as an alternative, further embodiments may include a moveable cover disposed on the safety brake actuation mechanism to maintain a sealed interior compartment during non-actuation of the safety brake.

In addition to one or more of the features described above, or as an alternative, further embodiments may include that the inner edge of the first rigid plate is spaced at least 1 millimeter from the inner surface of the first guiding pad and the sensing device is spaced at least 1.5 millimeters from the inner surface of the first guiding pad.

In addition to one or more of the features described above, or as an alternative, further embodiments may include that the sensing device is an optical sensor.

In addition to one or more of the features described above, or as an alternative, further embodiments may include that the safety brake actuation mechanism comprises a first side subassembly and a second side subassembly, the first rigid plate at least partially coupling the first side subassembly and the second side subassembly to each other.

In addition to one or more of the features described above, or as an alternative, further embodiments may include that the safety brake actuation mechanism comprises a first side subassembly, a second side subassembly, and a connector, the connector operatively coupling the first side subassembly and the second side assembly to each other.

In addition to one or more of the features described above, or as an alternative, further embodiments may include that the safety brake actuation mechanism is a single, integrally formed assembly.

According to another embodiment, a brake assembly for an elevator system includes a guide rail configured to guide movement of an elevator car. Also included is a safety brake operatively coupled to the elevator car and having a brake surface configured to frictionally engage the guide rail. Further included is a safety brake actuation mechanism operatively coupled to the safety brake and configured to actuate the brake member to a braking position. The safety brake actuation mechanism includes a sensing device disposed at a distance from the guide rail to determine a speed of the elevator car relative to the guide rail. The safety brake actuation mechanism also includes a first guiding pad having an inner surface disposed at a distance from the guide rail that is less than the distance that the sensing device is spaced from the guide rail, said first guiding pad configured to prevent the sensing device from contacting debris disposed on the guide rail.

In addition to one or more of the features described above, or as an alternative, further embodiments may include a first rigid plate having an inner edge disposed at a distance from the guide rail that is less than the distance that the sensing device is spaced from the guide rail, said first rigid plate configured to prevent the sensing device from contacting debris disposed on the guide rail, wherein the inner surface of the guiding pad is disposed at a distance from the guide rail that is less than the distance that the first rigid plate is spaced from the guide rail. Also included is a first brush disposed between the first rigid plate and the first guiding pad, the first brush extending to a location closer to the guide rail than the first rigid plate.

According to another embodiment, a method of protecting a speed sensing element of an elevator system is provided. The method includes disposing a sensing device on a safety brake actuation mechanism at a distance from a guide rail. The method also includes disposing a rigid plate on the safety brake actuation mechanism at a distance from the guide rail that is less than the distance that the sensing device is spaced from the guide rail. The method further includes scraping debris disposed on the guide rail with the rigid plate to prevent the sensing device from contacting debris disposed on the guide rail.

In addition to one or more of the features described above, or as an alternative, further embodiments may include disposing a guiding pad on the safety brake actuation mechanism at a distance from the guide rail that is less than the distance that the rigid plate is spaced from the guide rail. Also included is moving debris disposed on the guide rail with the guiding pad.

In addition to one or more of the features described above, or as an alternative, further embodiments may include disposing a brush between the rigid plate and the guiding pad, the brush extending to a location closer to the guide rail relative to the distance between the rigid plate and the guide rail. Also included is moving debris disposed on the guide rail with the guiding pad.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 2:
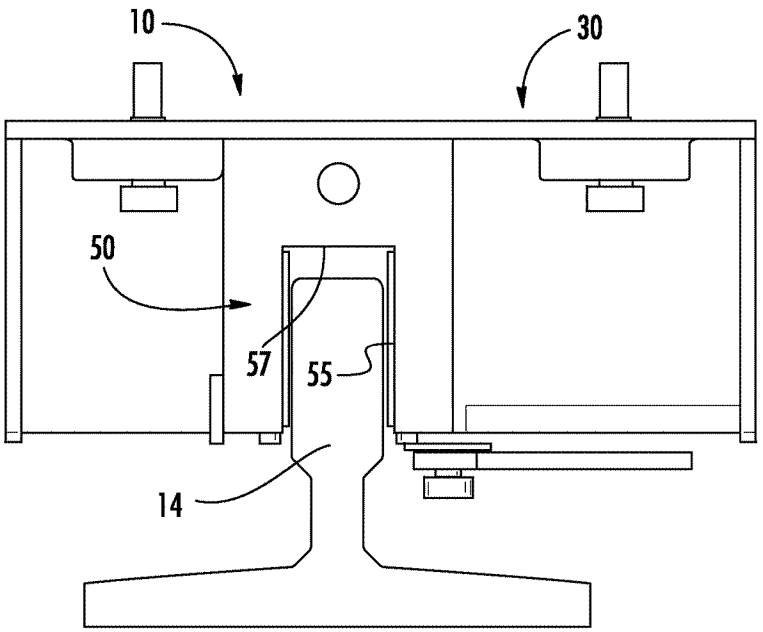
FIG. 2 is a plan view of the safety brake actuation mechanism and a guide rail.
Figure 1:
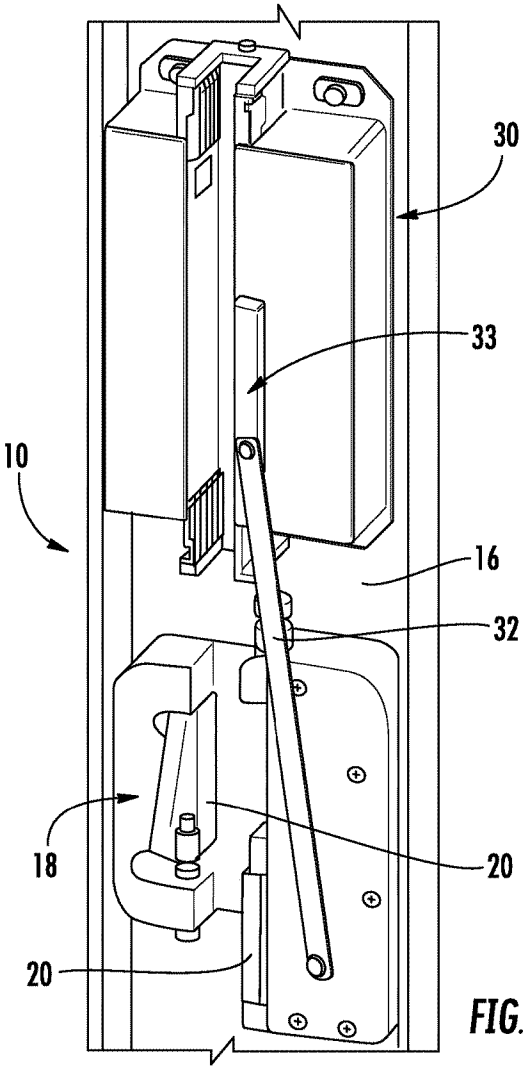
FIG. 1 is a perspective view of a brake assembly for an elevator system having a safety brake and a safety brake actuation mechanism.

Referring to FIGS. 1 and 2, a brake assembly 10 for an elevator system is illustrated. The embodiments described herein relate to an overall braking system that is operable to assist in braking (e.g., slowing or stopping movement) of an elevator car, relative to a guide rail 14, as will be described in detail below. The brake assembly 10 can be used with various types of elevator systems. For example, the embodiments described herein may be used with roped or ropeless elevator systems. In some embodiments, the brake assembly 10 is used for a counterweight.

The guide rail 14, is connected to a sidewall of an elevator car passage and is configured to guide the elevator car, typically in a vertical manner. The guide rail 14 may be formed of numerous suitable materials, typically a durable metal, such as steel, for example.

With reference to FIG. 1, the brake assembly 10 includes a mounting structure 16, such as an elevator car frame, and a safety brake 18. The safety brake 18 includes a brake pad or a similar structure suitable for repeatable braking engagement with the guide rail 14. The mounting structure 16 is connected to the elevator car and the safety brake 18 is positioned on the mounting structure 16 in a manner that disposes the brake member 18 in proximity with the guide rail 14. The safety brake 18 includes at least one component having a contact surface 20 that is operable to frictionally engage the guide rail 14. The safety brake 18 is moveable between a non-braking position and a braking position. The non-braking position is a position that the safety brake 18 is disposed in during normal operation of the elevator car. In particular, the safety brake 18 is not in contact with the guide rail 14 while in the non-braking position, and thus does not frictionally engage the guide rail 14. In the braking position, the frictional force between the contact surface 20 of the safety brake 18 and the guide rail 14 is sufficient to stop movement of the elevator car relative to the guide rail 14.

In operation, an electronic sensing device and/or control system (not illustrated) is configured to monitor various parameters and conditions of the elevator car and to compare the monitored parameters and conditions to at least one predetermined condition. In one embodiment, the predetermined condition comprises velocity and/or acceleration of the elevator car. In the event that the monitored condition exceeds the predetermined condition (e.g., over-speed, over-acceleration, etc.), a safety brake actuation mechanism 30 is actuated to facilitate engagement of the safety brake 18 and the guide rail 14. Various triggering mechanisms or components may be employed to actuate the safety brake actuation mechanism 30. In the illustrated embodiment, a link member 32 is provided and is operatively coupled to the safety brake actuation mechanism 30 and the safety brake. Movement of the link member 32 triggers movement of the safety brake 18 from the non-braking position to the braking position. A moveable cover 33 is disposed over a cutout of the safety brake actuation mechanism 30 and is configured to maintain closure of the mechanism in a sealed manner during non-actuation of the safety brake.

Figure 4:
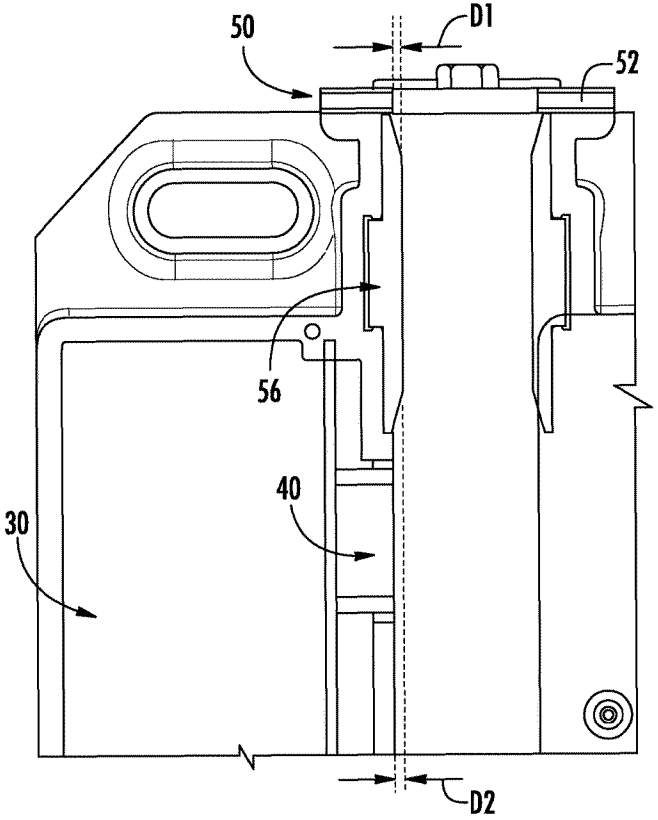
FIG. 4 is a side, elevation view of a portion of the safety brake actuation mechanism.
Figure 3:
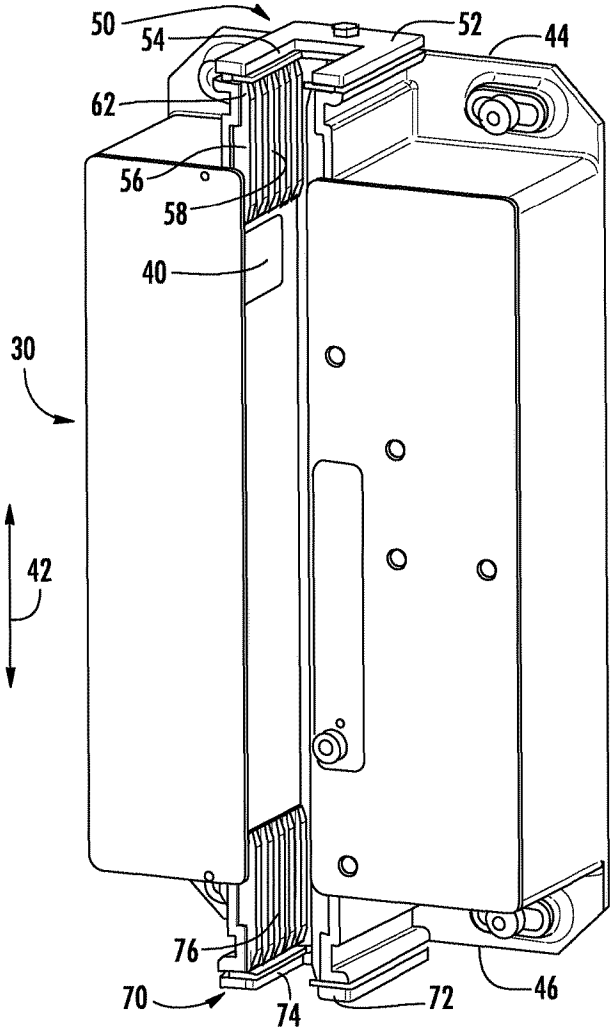
FIG. 3 is a perspective view of the safety brake actuation mechanism according to an embodiment.

Referring now to FIGS. 3 and 4, the safety brake actuation mechanism 30 is illustrated in greater detail. The safety brake actuation mechanism 30 includes a sensing device 40, such as a sensor that is configured to detect the speed or acceleration of the elevator car, relative to the guide rail 14. In some embodiments, the sensing device 40 is an optical sensor. Although the sensing device 40 is nominally positioned at a distance that will avoid contact with the guide rail 14, it is possible that debris is disposed on the guide rail 14. To ensure that damage to the sensing device 40 is avoided by debris contact, at least one protection component is provided on the safety brake actuation mechanism 30.

The safety brake actuation mechanism 30 extends along a direction 42 from a first end 44 to a second end 46. Operatively coupled to the safety brake actuation mechanism 30 and disposed on one side of the sensing device 40 is a first protection assembly 50. In one embodiment, the first protection assembly 50 is located at or proximate the first end 44 of the safety brake actuation mechanism 30. The first protection assembly 50 may be secured to the safety brake actuation mechanism 30 in any suitable manner, including, but not limited to, with adhesive, mechanical fasteners or welding, for example.

The first protection assembly 50 includes a first rigid plate 52. In the illustrated embodiment, the first rigid plate 52 is a substantially U-shaped member that at least partially surrounds the guide rail 14. The first rigid plate 52 is formed of any suitable rigid material, such as steel or another durable metal. The first rigid plate 52 includes an inner edge 54 that is disposed closer in proximity to the guide rail 14 when compared to the distance between the sensing device 40 and the guide rail 14. In some embodiments, the inner edge 54 is about 1.5 millimeters to about 2.0 millimeters closer to the guide rail 14 along side 55 and about 5.0 millimeters to about 7.0 millimeters closer to the guide rail 14 along side 57. In some embodiments, the inner edge 54 may be less than 1.5 millimeters or greater than 2.0 millimeters closer to the guide rail 14 along side 55. In some embodiments, the inner edge 54 is may be less than 5.0 millimeters or greater than 7.0 millimeters closer to the guide rail 14 along side 57. The first protection assembly 50 also includes a first guiding pad 56 operatively coupled to the safety brake actuation mechanism 30. The first guiding pad 56 includes an inner surface 58 that is disposed closer in proximity to the guide rail 14 when compared to the distance between the inner edge 54 of the first rigid plate 52 and the guide rail 14. The first guiding pad 56 is formed of a non-metal material that is configured to dislodge material disposed on the guide rail 14 as the safety brake actuation mechanism 30 moves along the guide rail 14. For materials on the guide rail 14 that are not sufficiently dislodged by the first guiding pad 56, the first rigid plate 52 is strong enough to do so. Additionally, the first rigid plate 52 provides an indicator that the first guiding pad 56 has worn away to an extent that requires replacement of the first guiding pad 56. This alert is audibly present due to consistent scraping of the first rigid plate 52 and the guide rail 14. Due to wear, the effective distance of the guiding pad 56 to the rail surface is not greater than the effective distance between the inner edge 54 of the first rigid plate 52 and the guide rail 14. As a result, metal-to-metal contact generates a loud scraping noise when there is relative motion, which provides an alert that guiding pad 56 replacement is needed.

Figure 5:
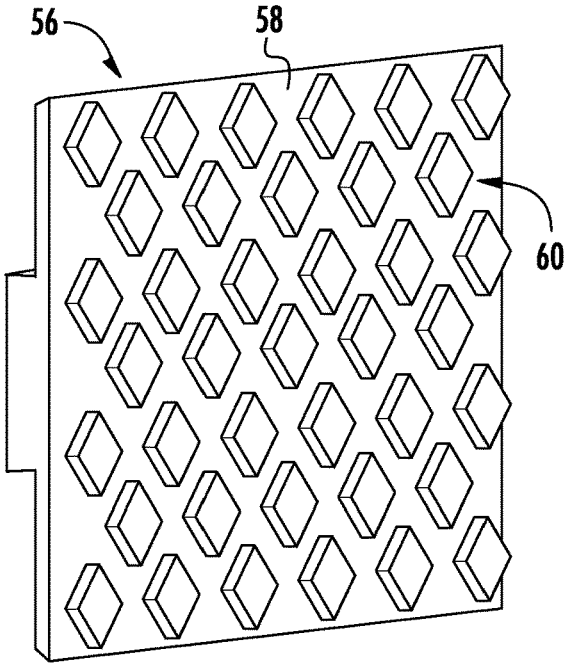
FIG. 5 is an embodiment of a guiding pad of the safety brake actuation mechanism.
Figure 6:
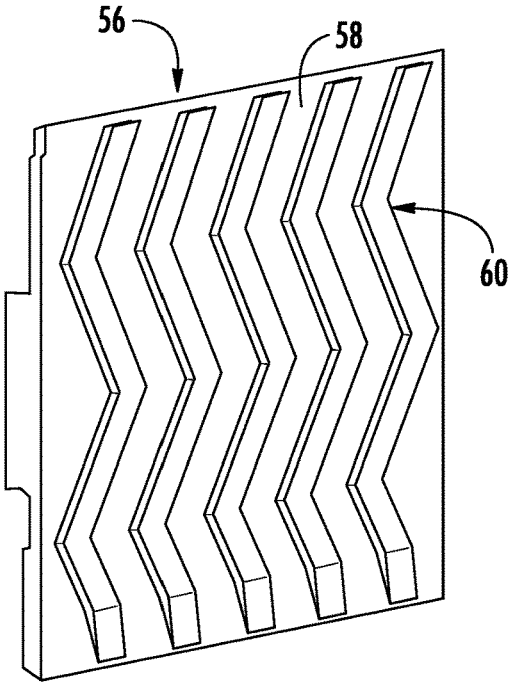
FIG. 6 is an embodiment of a guiding pad of the safety brake actuation mechanism.

As shown, in FIGS. 5 and 6, the inner surface 58 of the first guiding pad 56 includes a protrusion pattern 60 extending therefrom. The protrusion pattern 60 may be any torturous path that does not allow a straight through vertical path for material. The illustrated protrusion patterns are merely illustrative and are not limiting of the large number of variations that may be employed.

Referring back to FIG. 3, in some embodiments, the first protection assembly 50 also includes an optional first brush 62 disposed between the first rigid plate 52 and the first guiding pad 56. The first brush 62 extends to a location closer to the guide rail 14 when compared to the distance between the inner edge 54 of the first rigid plate 52 and the guide rail 14. The first brush 62 is configured to reduce dust exposure to the sensing device 40 due to the clearance between the protrusion pattern 60 of the first guiding pad 56 and the inner edge 54 of the first rigid plate 52. In some embodiments, as shown in FIG. 4, the clearance d1 between the protrusion pattern 60 of the guiding pad 56 and the inner edge 54 is equal to or greater than about 1 millimeter and the clearance d2 between the protrusion pattern 60 and the sensing device 40 is equal to or greater than about 1.5 millimeters. In some embodiments, the clearance d1 between the protrusion pattern 60 of the guiding pad 56 and the inner edge 54 is less than about 1 millimeter and the clearance d2 between the protrusion pattern 60 and the sensing device 40 less than about 1.5 millimeters.

It is to be appreciated that the first protection assembly 50 is disposed on both sides of the guide rail 14. In other words, although described as a single guiding pad and a single brush, it is to be understood that in some embodiments, these components are U-shaped as the first rigid plate 52 is to wrap around the guide rail 14 or are provided as a pair of identical components that are located on each side of the guide rail 14. It is to be further understood that the first protection assembly 50 may include less than all of the described components to facilitate protection of the sensing device 40. For example, only a rigid plate may be provided, only a guiding pad may be provided and/or only a brush may be provided. Alternatively, combinations of these components may be employed.

Referring again to FIG. 3, in some embodiments a second protection assembly 70 is provided. The second protection assembly 70 includes similar or identical components as that of the first protection assembly 50, but is located on an opposite side of the sensing device 40 along direction 42. In some embodiments, the second protection assembly 70 is located at or proximate the second end 46 of the safety brake actuation mechanism 30. The second protection assembly 70 includes a second rigid plate 72, a second guiding pad 74 and a second brush 76, thereby providing a pair of protection assemblies, a pair of rigid plates, a pair of guiding pads and a pair of brushes. The relative dimensioning of these components is similar or identical to the relative dimensioning of the corresponding components of the second protection assembly 70. Therefore, description of the structure and orientation of the components of the second protection assembly 70 is not duplicated herein.

Placement of the first protection assembly 50 and the second protection assembly 70 on opposite sides of the sensing device 40 along the direction 42 ensures that material disposed on the guide rail 14 is dislodged and diverted from the sensing device 40 to avoid potential damage to the sensing device.

Figure 8:
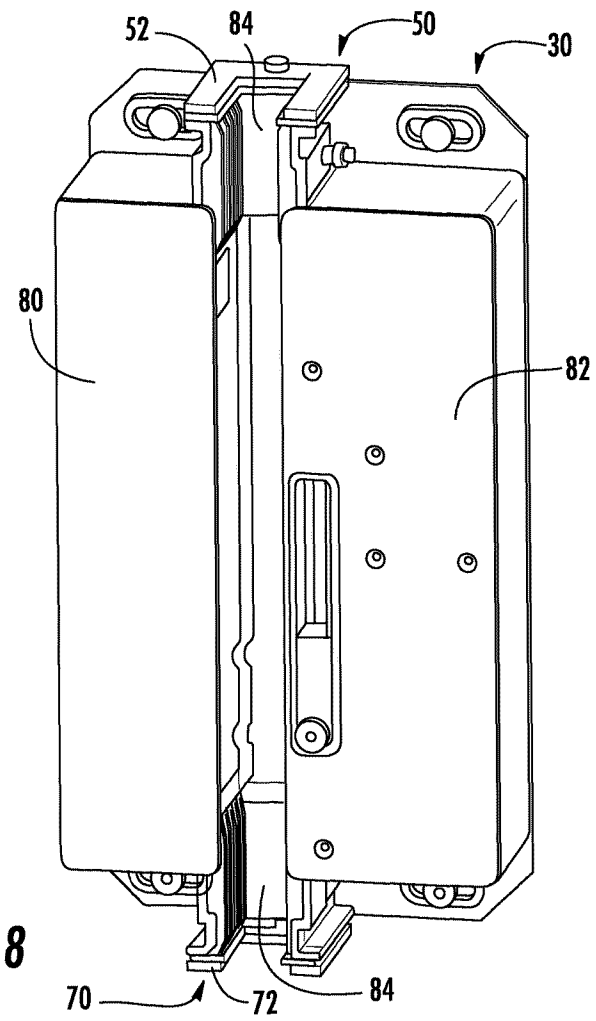
FIG. 8 is a perspective view of the safety brake actuation mechanism according to another embodiment.
Figure 7:
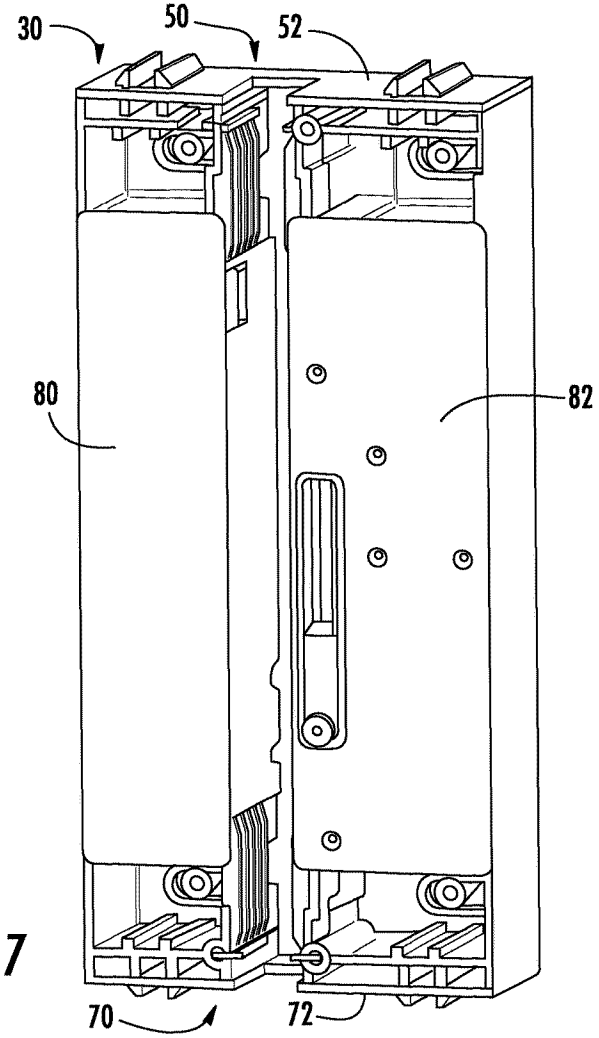
FIG. 7 is a perspective view of the safety brake actuation mechanism according to another embodiment.

In the illustrated embodiments of FIGS. 1-6, the safety brake actuation mechanism 30 is shown as a single, integrally formed assembly. In the embodiments shown in FIGS. 7 and 8, the safety brake actuation mechanism 30 is formed of a first side subassembly 80 and a second side subassembly 82 that are not directly coupled. The embodiment of the safety brake actuation mechanism 30 of FIG. 7 illustrates coupling of the first and second side subassemblies 80, 82 with the first and second rigid plates 52, 72. The embodiment of the safety brake actuation mechanism 30 of FIG. 8 illustrates coupling of the first and second side subassemblies 80, 82 with one or more connectors 84 disposed on the mechanism as one or more back plates that provide an interface to couple the subassemblies to.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A brake assembly for an elevator system comprising:

a guide rail configured to guide movement of an elevator car;

a safety brake operatively coupled to the elevator car and having a brake surface configured to frictionally engage the guide rail; and a safety brake actuation mechanism operatively coupled to the safety brake and configured to actuate the brake member to a braking position, the safety brake actuation mechanism comprising:

a sensing device disposed at a distance from the guide rail to determine a speed of the elevator car relative to the guide rail; and a first rigid plate having an inner edge disposed at a distance from the guide rail that is less than the distance that the sensing device is spaced from the guide rail, said first rigid plate configured to prevent the sensing device from contacting debris disposed on the guide rail.

2. The brake assembly of claim 1, the safety brake actuation mechanism further comprising a first guiding pad having an inner surface disposed at a distance from the guide rail that is less than the distance that the first rigid plate is spaced from the guide rail.

3. The brake assembly of claim 2, wherein the inner surface of the first guiding pad includes a protrusion pattern extending therefrom, the protrusion pattern comprising a torturous path.

4. The brake assembly of claim 3, the safety brake actuation mechanism further comprising a first brush disposed between the first rigid plate and the first guiding pad, the first brush extending to a location closer to the guide rail than the first rigid plate.

5. The brake assembly of claim 4, wherein the first rigid plate, the first guiding pad and the first brush are disposed on a first side of the sensing device, the safety brake actuation mechanism further comprising:

a second rigid plate disposed on a second side of the sensing device and having an inner edge disposed at a distance from the guide rail that is less than the distance that the sensing device is spaced from the guide rail, said first rigid plate configured to prevent the sensing device from contacting debris disposed on the guide rail;

a second guiding pad disposed on a second side of the sensing device and having an inner surface disposed at a distance from the guide rail that is less than the distance that the second rigid plate is spaced from the guide rail; and a second brush disposed between the second rigid plate and the second guiding pad, the second brush extending to a location closer to the guide rail than the second rigid plate.

6. The brake assembly of claim 2, wherein the inner edge of the first rigid plate is spaced at least 1 millimeter from the inner surface of the first guiding pad and the sensing device is spaced at least 1.5 millimeters from the inner surface of the first guiding pad.

7. The brake assembly of claim 1, wherein the first rigid plate is formed of steel.

8. The brake assembly of claim 1, further comprising a moveable cover disposed on the safety brake actuation mechanism to maintain a sealed interior compartment during actuation of the safety brake.

9. The brake assembly of claim 1, wherein the sensing device is an optical sensor.

10. The brake assembly of claim 1, wherein the safety brake actuation mechanism comprises a first side subassembly and a second side subassembly, the first rigid plate at least partially coupling the first side subassembly and the second side subassembly to each other.

11. The brake assembly of claim 1, wherein the safety brake actuation mechanism comprises a first side subassembly, a second side subassembly, and a connector, the connector operatively coupling the first side subassembly and the second side assembly to each other.

12. The brake assembly of claim 1, wherein the safety brake actuation mechanism is a single, integrally formed assembly.

13. A brake assembly for an elevator system comprising:

a guide rail configured to guide movement of an elevator car;

a safety brake operatively coupled to the elevator car and having a brake surface configured to frictionally engage the guide rail; and a safety brake actuation mechanism operatively coupled to the safety brake and configured to actuate the brake member to a braking position, the safety brake actuation mechanism comprising:

a sensing device disposed at a distance from the guide rail to determine a speed of the elevator car relative to the guide rail; and a first guiding pad having an inner surface disposed at a distance from the guide rail that is less than the distance that the sensing device is spaced from the guide rail, said first guiding pad configured to prevent the sensing device from contacting debris disposed on the guide rail.

14. The brake assembly of claim 13, further comprising:

a first rigid plate having an inner edge disposed at a distance from the guide rail that is less than the distance that the sensing device is spaced from the guide rail, said first rigid plate configured to prevent the sensing device from contacting debris disposed on the guide rail, wherein the inner surface of the guiding pad is disposed at a distance from the guide rail that is less than the distance that the first rigid plate is spaced from the guide rail; and a first brush disposed between the first rigid plate and the first guiding pad, the first brush extending to a location closer to the guide rail than the first rigid plate.

15. A method of protecting a speed sensing element of an elevator system comprising:

disposing a sensing device on a safety brake actuation mechanism at a distance from a guide rail;

disposing a rigid plate on the safety brake actuation mechanism at a distance from the guide rail that is less than the distance that the sensing device is spaced from the guide rail; and scraping debris disposed on the guide rail with the rigid plate to prevent the sensing device from contacting debris disposed on the guide rail.

16. The method of claim 15, further comprising:

disposing a guiding pad on the safety brake actuation mechanism at a distance from the guide rail that is less than the distance that the rigid plate is spaced from the guide rail; and moving debris disposed on the guide rail with the guiding pad.

17. The method of claim 15, further comprising:

disposing a brush between the rigid plate and the guiding pad, the brush extending to a location closer to the guide rail relative to the distance between the rigid plate and the guide rail; and moving debris disposed on the guide rail with the guiding pad.

* * * * *